US006067920A

United States Patent [19]

Uemoto

[11] Patent Number: 6,067,920

[45] Date of Patent: May 30, 2000

[54] THREADING APPARATUS FOR SEWING MACHINE

[75] Inventor: Haruyoshi Uemoto, Komaki, Japan

[73] Assignee: Step y.k., Japan

[21] Appl. No.: 09/343,771

[22] Filed: Jun. 30, 1999

[30] Foreign Application Priority Data

Jul. 3, 1998 [JP] Japan ..... 10-189316

[51] Int. Cl.[7] ..... D05B 87/00

[52] U.S. Cl. ..... 112/225

[58] Field of Search ..... 112/DIG. 2, DIG. 3, 112/228, 224, 225, 286; 223/99

[56] References Cited

U.S. PATENT DOCUMENTS

| | | | |
|---|---|---|---|
| 1,360,400 | 11/1920 | Hill | 223/99 |
| 2,413,014 | 12/1946 | Wall | 112/225 |
| 3,540,392 | 11/1970 | Kaplan | 112/225 |
| 3,599,587 | 8/1971 | Greulich | 112/225 |

FOREIGN PATENT DOCUMENTS 7-88276 of 1995 Japan .

*Primary Examiner*—Ismael Izaguirre
*Attorney, Agent, or Firm*—Mathews, Collins, Shepherd & Gould, P.A.

[57] ABSTRACT

The present invention provides an air suction device for a threading apparatus that creates an air flow to be directed toward a needle eye in order to guide a yarn through the eye. The air suction device is comprised of:

(a) an air device externally provided for generating reduced pressure;

(b) an air suction pipe connected to the external air device; and (c) an air path leading to a front portion of the air suction pipe.

The air path is comprised of a pair of leaf springs to horizontally hold a needle, and upper and lower elastic members which run parallel between the pair of leaf springs. To effectively direct air into the needle eye, an air-tight environment is provided around the needle eye: (1) air entry above and beneath the needle eye is prevented by the body of the needle; (2) air entry from both sides of the needle is prevented by the pair of leaf springs that hold the needle; and (3) air inflow behind the needle is prevented by rear-positioned elastic members which tightly fit the needle.

6 Claims, 10 Drawing Sheets

THREADING APPARATUS FOR SEWING MACHINE

BACKGROUND OF THE INVENTION

1. Field of the Invention

The present invention relates to a threading apparatus to be attached to a sewing machine or an embroidering machine to automatically guide a sewing yarn into a needle eye.

2. Prior Art

Manual threading, in itself, is a laborious operation even for young people with good eyesight. It is tremendously laborious for elderly people. Poor lighting on needle eyes makes the threading operation tougher. Needless to say, manual threading for an embroidering machine as shown in FIG. 7 requires more time and energy because many needles are involved.

To ease threading operations, various attempts have been made. Japanese Patent Laid-Open Publication No.7-88276 (FIG. 10, prior art) discloses that a threading apparatus 1 is comprised of:

(1) a needle insertion hole 3 provided vertically in the body 2;

(2) a suction hole 4 intersecting with the needle insertion hole 3; and (3) a pipe 15 connected to the insertion hole 4 and a suction chamber 20 for threading a yarn into a needle eye by means of sucked air when the needle is in the insertion hole 3.

The disclosed device above can be used for sewing as well as embroidery lace needles to thread a yarn instantaneously. However, the following technical problems exist.

(1) When a needle is inserted in the needle insertion hole 3, room or gap is left in the insertion hole 3 and unwanted air enters the room. As a result, incoming air weakens the air flow from the suction hole 4, and a yarn may not be properly guided into a small needle eye.

(2) A shallowly inserted needle does not provide air-tight condition in the insertion hole 3, which causes the same problem as described above. On the other hand, if a needle can substantially perfectly fits, leaving no gap in the insertion hole 3, the insertion operation itself will then become extremely hard. The needle can not be properly inserted into a desired position in the suction hole 3 easily.

(3) When a needle is lowered instantly into the insertion hole 3, the tip of the needle will be damaged upon touching the bottom of the insertion hole 3 because the needle is designed to go further down to pick up a bobbin thread.

(4) A threaded yarn will come off a needle if the yarn is caught or tangled during the needle lifting operation.

SUMMARY OF THE INVENTION

The present invention provides an air suction device for a threading apparatus that creates an air flow to be directed toward a needle eye in order to guide a yarn through the eye. The air suction device is comprised of:

(a) an air device externally provided for generating reduced pressure;

(b) an air suction pipe connected to the external air device; and (c) an air path leading to a front portion of the air suction pipe.

The air path is comprised of a pair of leaf springs to horizontally hold a needle, and upper and lower elastic members which run parallel between the pair of leaf springs.

To effectively direct air into the needle eye, an air-tight environment is provided around the needle eye: (1) air entry above and beneath the needle eye is prevented by the body of the needle; (2) air entry from both sides of the needle is prevented by the pair of leaf springs that hold the needle; and (3) air inflow behind the needle is prevented by rear-positioned elastic members which tightly fit the needle.

The present invention provides secure needle holding. Two protrusions of the thin and elastic metal materials hold the needle securely and tightly fit the elongated surface of the needle. One of the two protrusions is made longer than the other so as to function as a thread guide wall as well. On top of the thin and elastic metal materials are thick and non-elastic materials. These elastic and non-elastic materials integrally constitute a doubled layer structure of the leaf springs.

The present invention alleviates the colliding impact from a direct contact between the needle and the front portion of the elastic members. A buffer effect is provided by a biased spring built in the air suction pipe and the designed structural flexibility so as to protect the needle and the elastic members from being damaged upon their contact.

The present invention creates an air-tight environment especially along a slanting distal portion of the needle. The lower elastic member of the elastic members is formed such that it perfectly fits a rear-side distal portion of the tapered needle, totally eliminating air.

The present invention may or may not utilize a base. The air suction pipe of the air suction device reciprocates by means of an air cylinder.

DETAILED DESCRIPTION OF PREFERRED EMBODIMENT

The following description focuses on an embodiment of a threading apparatus 100.

Figure 9:
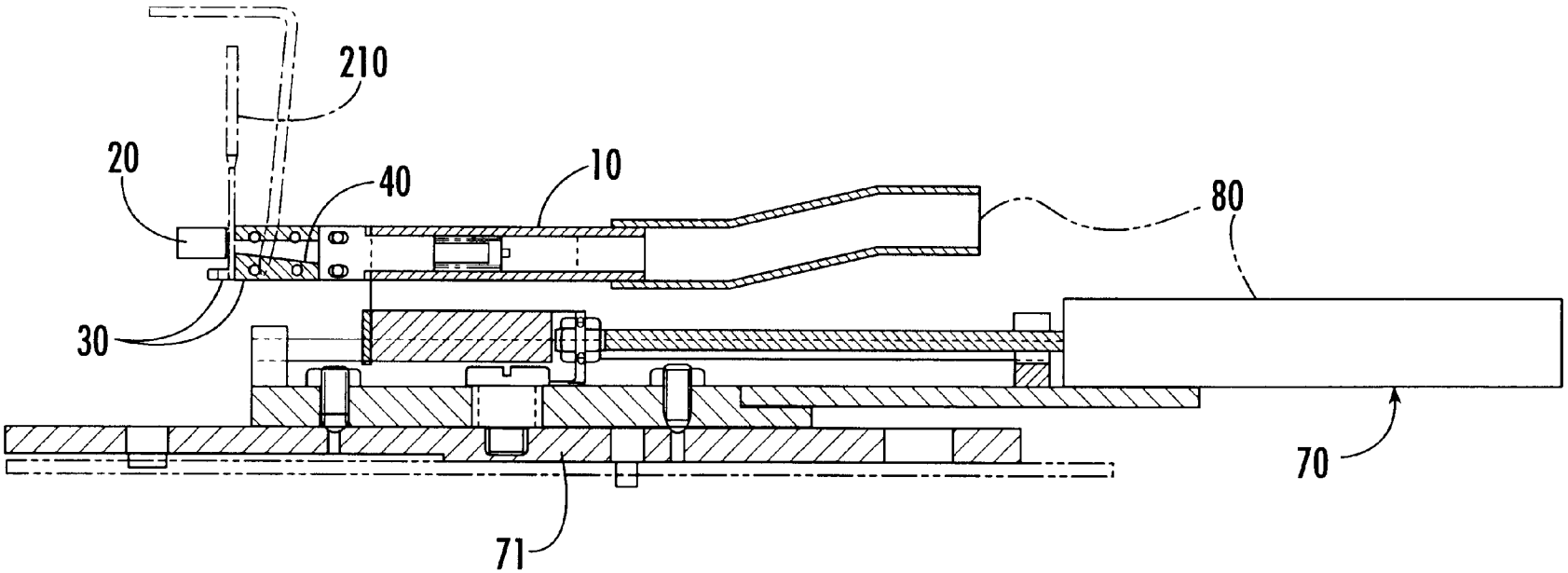
FIG. 9 is a sectional view showing the base and the air suction device of FIG. 8.
Figure 10:
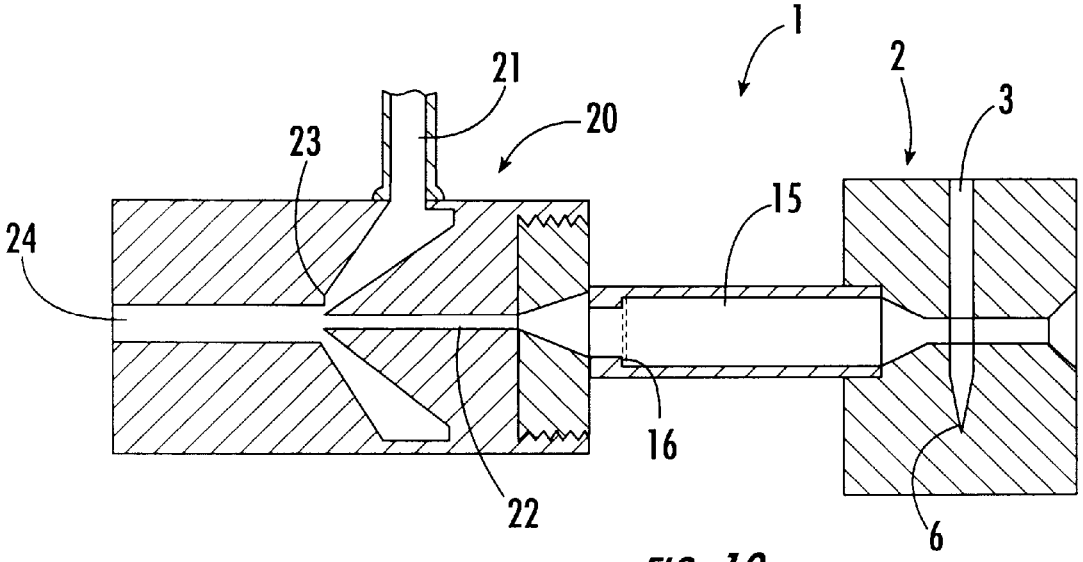
FIG. 10. PRIOR ART
FIG. 10 is a sectional view showing a conventional threading apparatus.

A threading apparatus 100 has an air suction device 100A for forming an air flow to be directed toward a needle eye 211 to guide a yarn through the eye 211. As illustrated in FIG. 9, the air suction device 100A is comprised of an external air device 80 generating reduced pressure, an air suction pipe 10 connected to the air device 80, and an air path 40 leading to the front portion of the air suction pipe 10.

Figure 1:
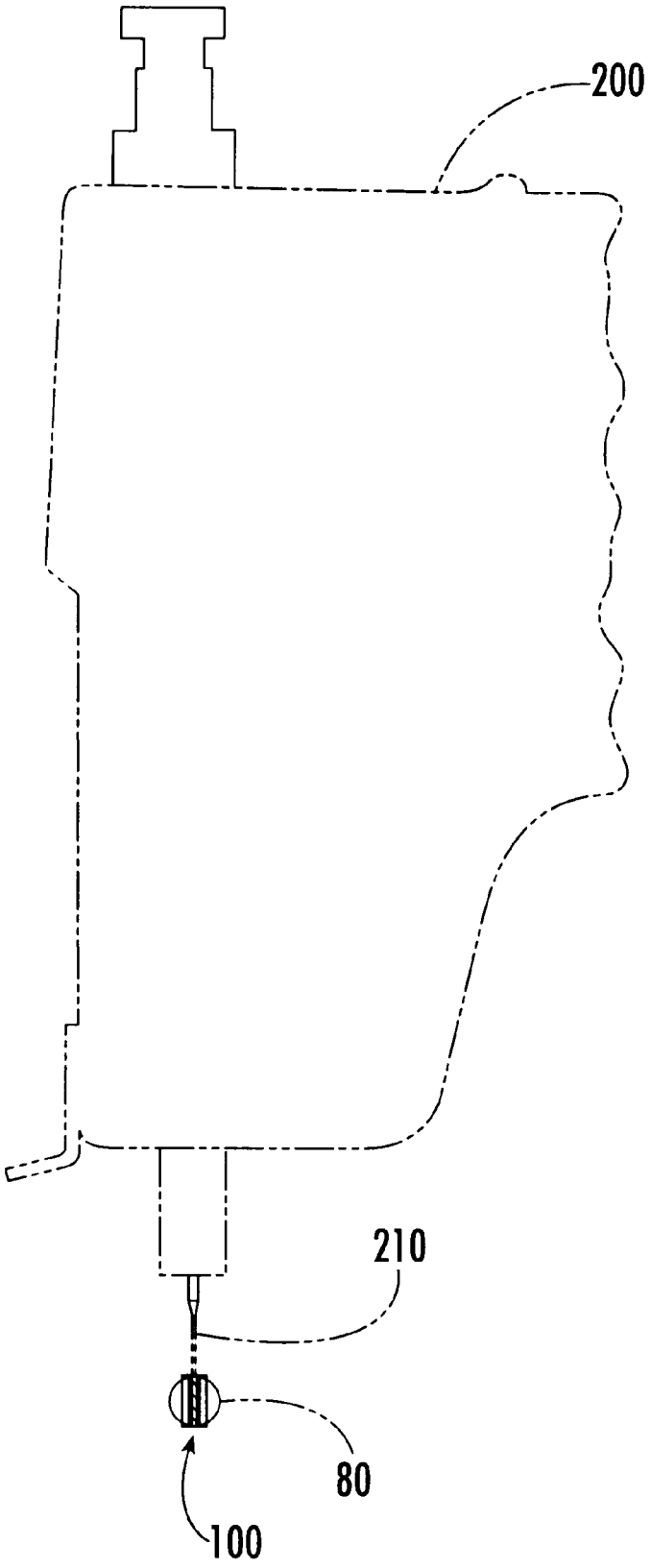
FIG. 1 partially shows a conventional sewing machine where a threading apparatus according to a preferred embodiment of the present invention is applied.
Figure 2:
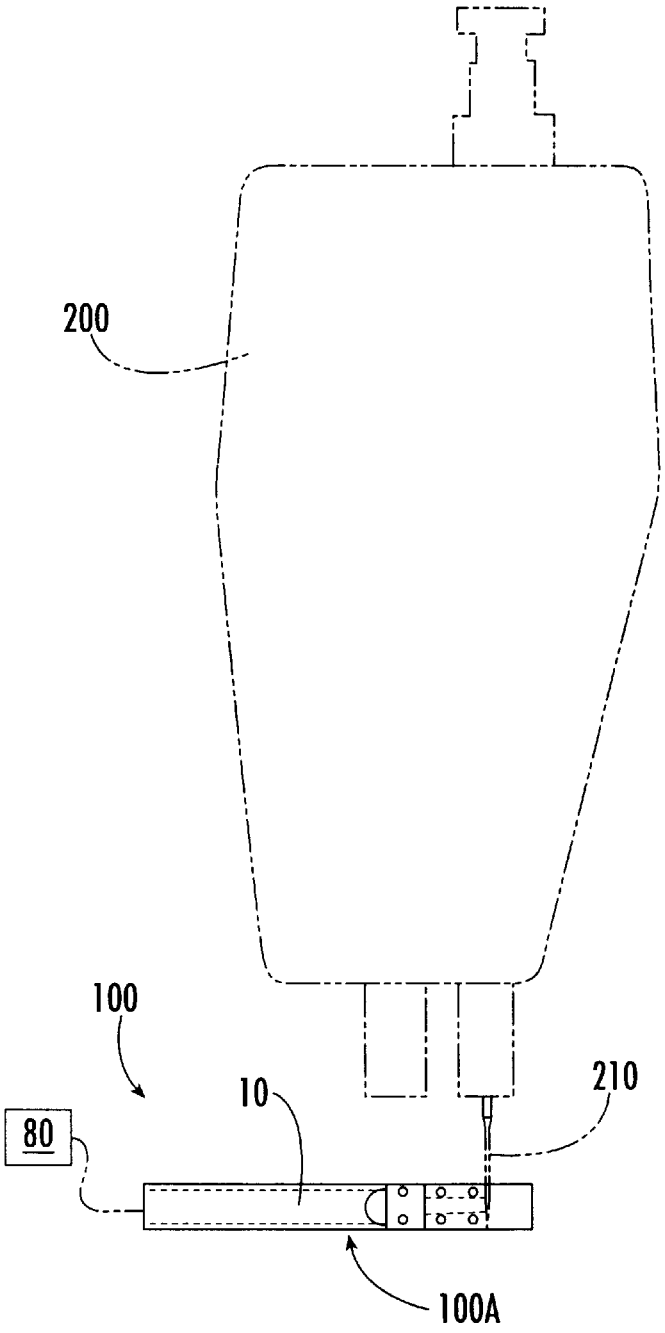
FIG. 2 shows another side of the sewing machine.
Figure 3:
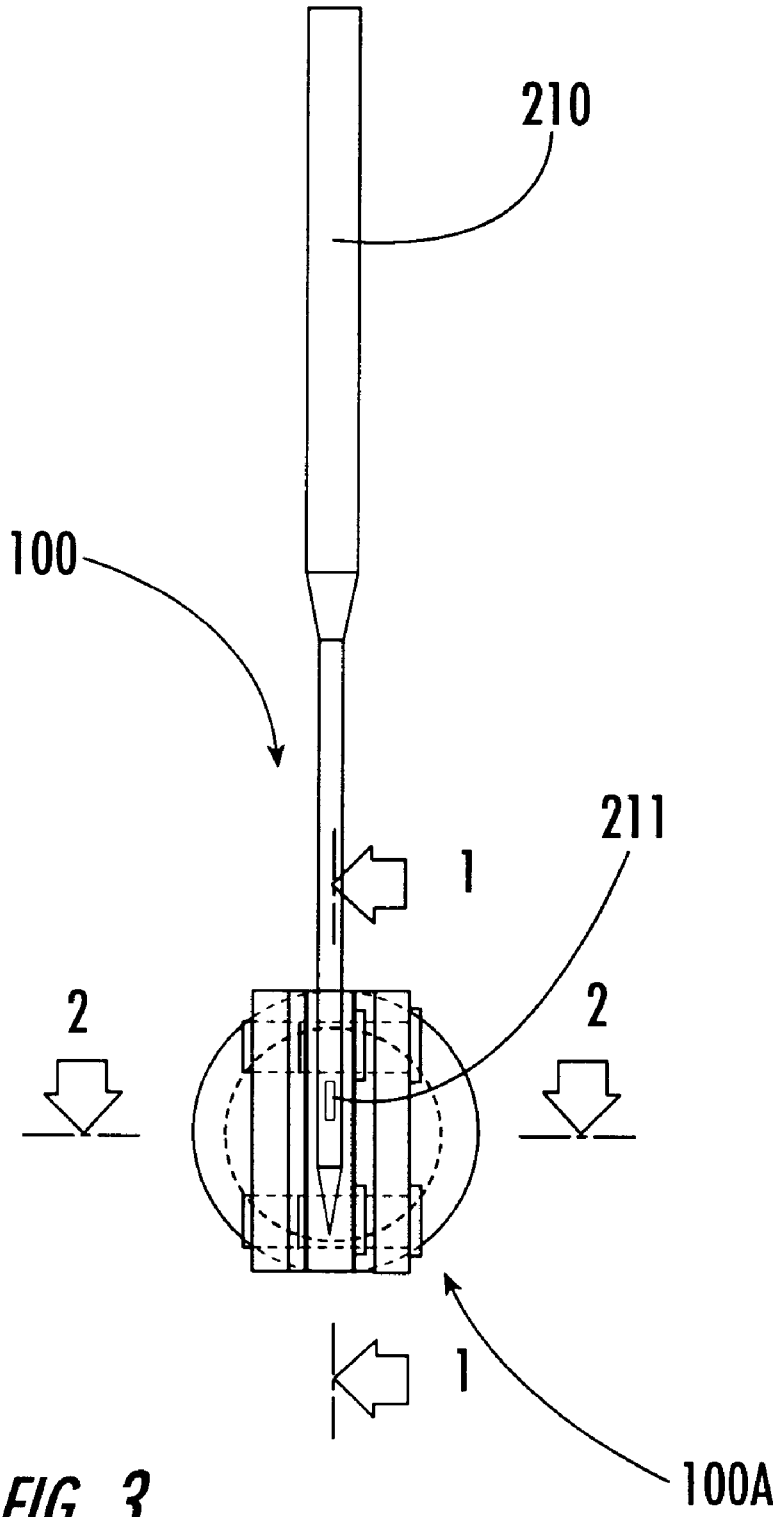
FIG. 3 is an enlarged view showing a relationship between a needle and an air suction device according to a preferred embodiment of the present invention.
Figure 8:
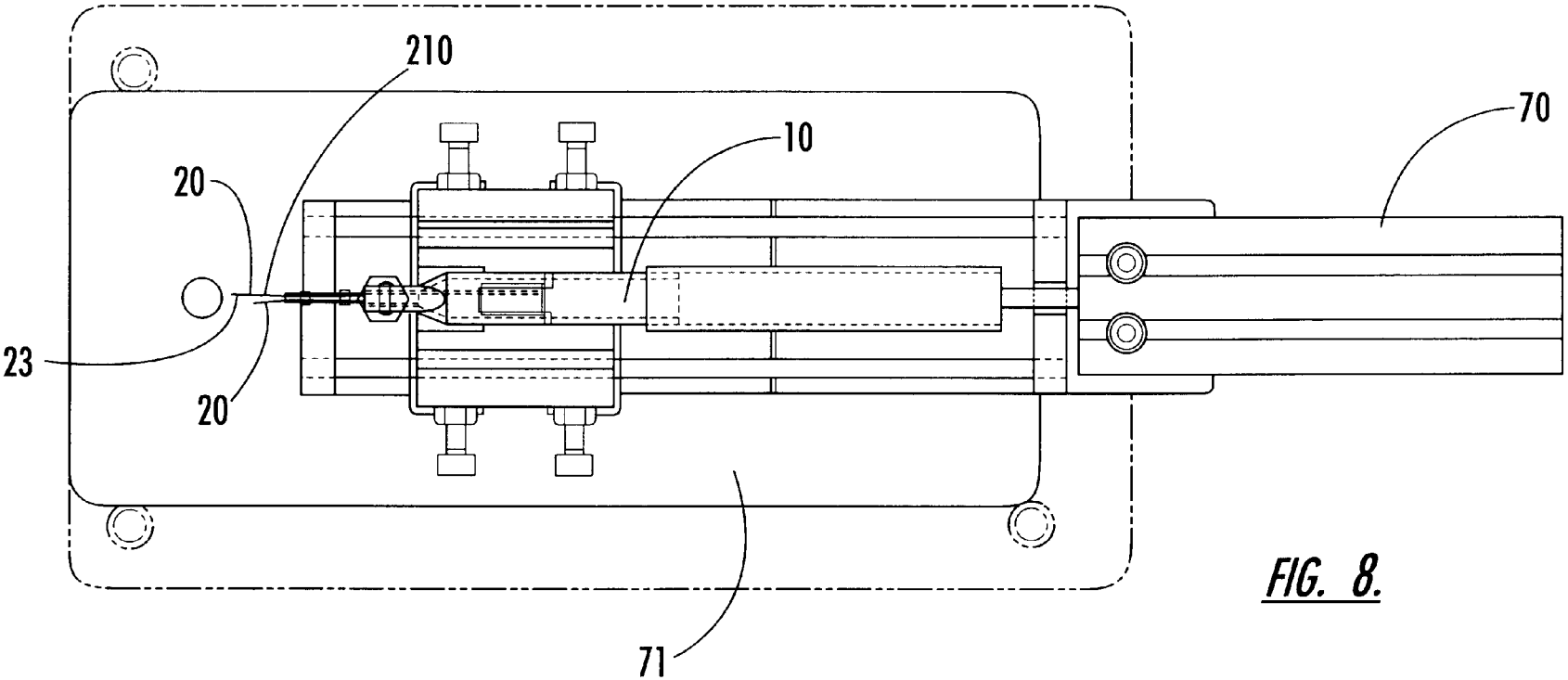
FIG. 8 is a plain view showing an air suction device mounted on a base.

The air path 40 is comprised of a pair of leaf springs 20,20 which hold a needle, and upper and lower elastic members in parallel 31,32 positioned between the pair of leaf springs 20,20. The upper and lower elastic members 31,32 are connected to the front portion of the air suction pipe 10, and made to perform forward and backward movements by means of an air cylinder 70 as shown in FIGS. 8 and 9 to assist the threading operation. With the air cylinder 70, the air suction device 100A is mounted on a base 71 as shown in FIGS. 8 and 9. The air suction device 100A is illustrated in FIGS. 1 and 2 as one approaching a needle 210 loaded on an ordinary sewing machine from behind.

Each leaf spring 20 is made of two kinds of metal materials 21,22. The material 21 is thin and elastic. The material 22 is thick and non-elastic, being placed on top of the metal material 21 partially overlapping it. The thick outer upper layers 22,22 support and reinforce the thin metal materials 21,21 which are firmly connected to the air suction pipe 10. Two protrusions 21*a*, 21*a* of the thin metal materials 21,21 stretch from the thick materials 22,22, and they are flexible enough to elastically hold the lower end of the needle 210. These two materials may be alternatively replaced by a single material which has combined natures of the above materials 21 and 22 if such a material becomes available.

Figure 5:
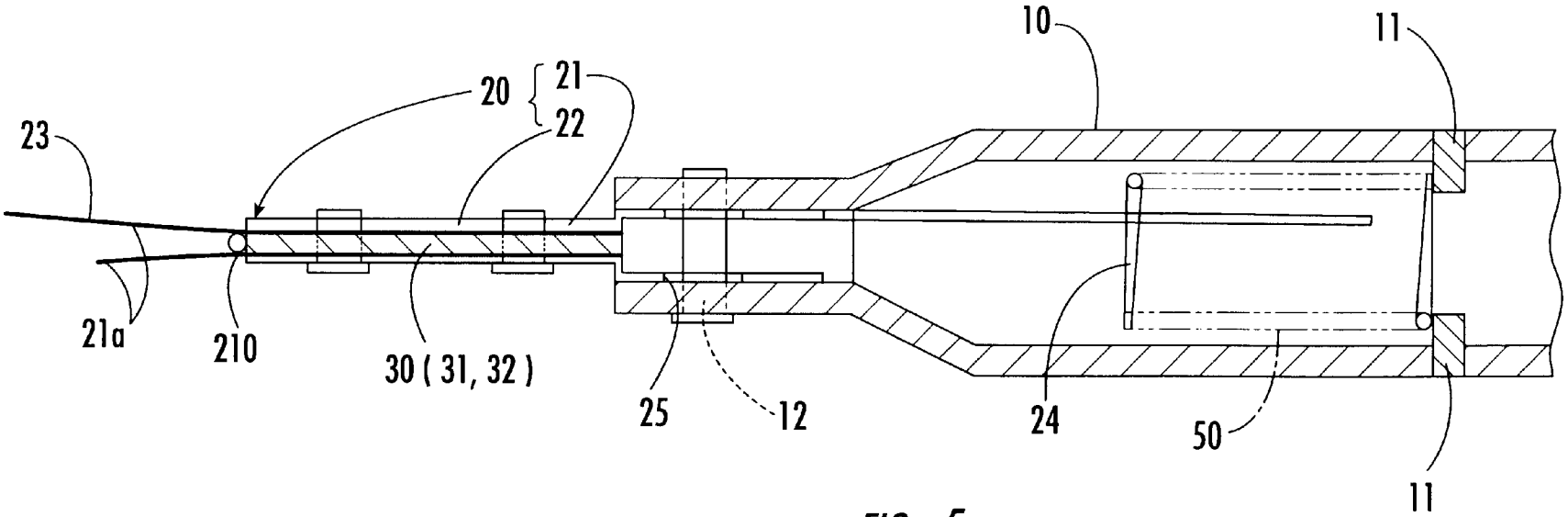
FIG. 5 is a cross sectional view taken along line 2—2 in FIG. 3.
Figure 6:
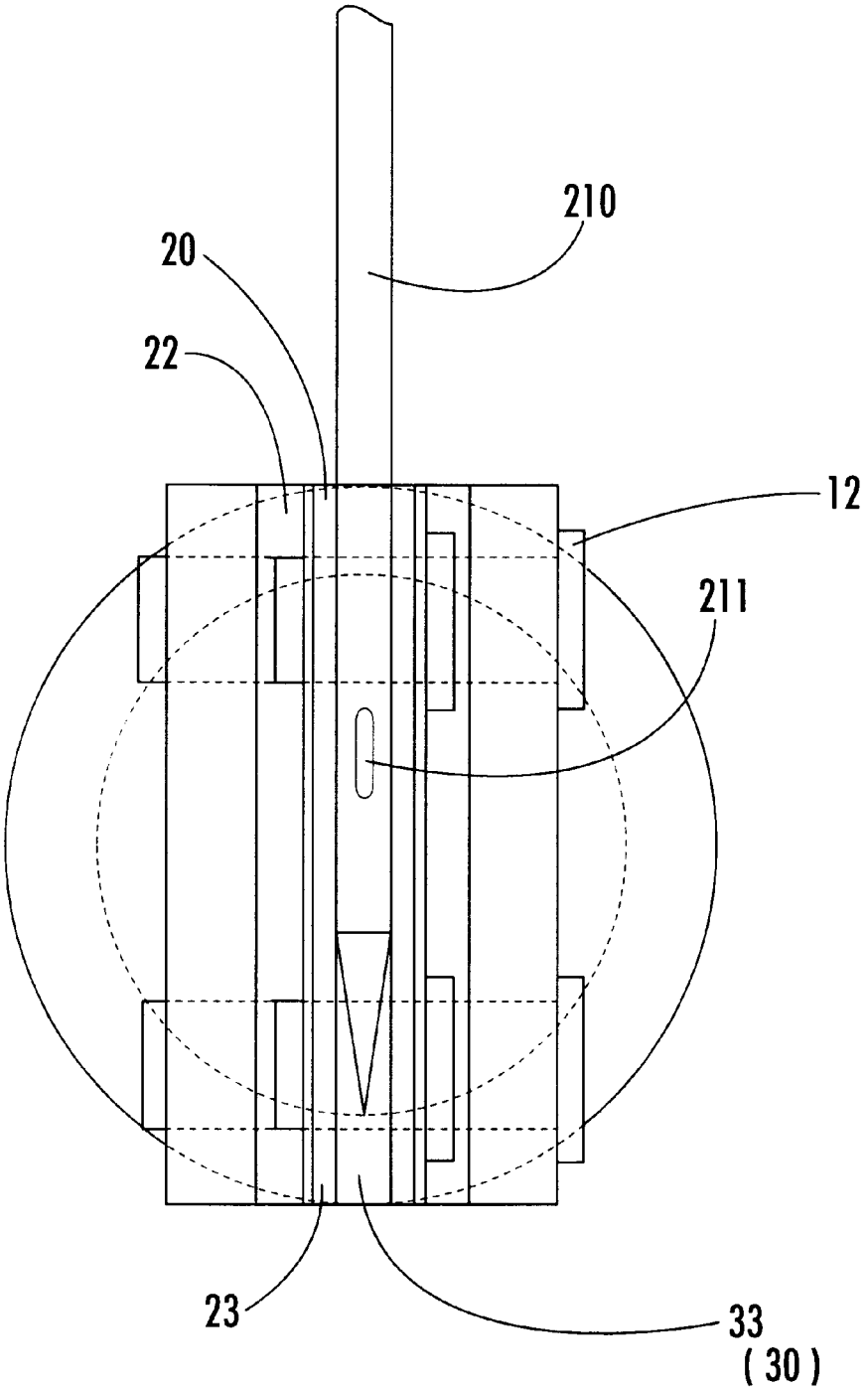
FIG. 6 is an enlarged view showing a front portion of an air suction device.

The protrusions 21*a*, 21*a* of the thin metal materials 21,21 are opened slightly and one protrusion 21*a* is made longer than the other to function as a thread guide wall 23 as shown in FIG. 5. The opened protrusions 21*a*, 21*a*, help grab the needle 210 easily and the thread guide wall 23 helps guide a yarn and air into the needle eye 211 securely. The thread guide wall 23 serves as a target to which the yarn is manually directed, then the yarn, assisted by air flow, will be instantly carried through the air suction device 100A.

Figure 4:
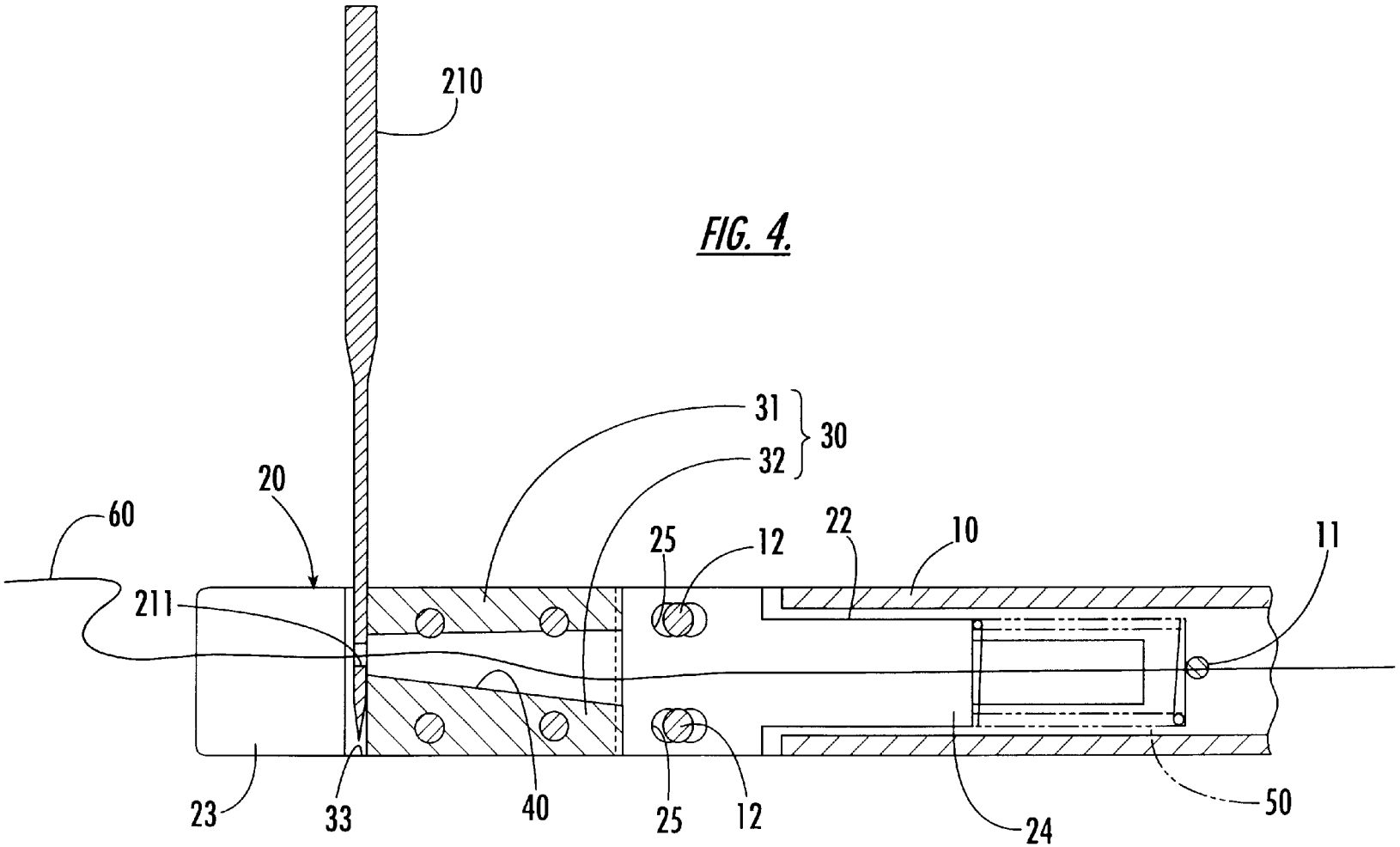
FIG. 4 is a sectional view taken along line 1—1 in FIG. 3.

Elastic members 30,30 are comprised of an upper elastic member 31 and a lower elastic member 32. The upper and lower elastic members 31,32, run parallel to each other and they are positioned between the metal leaf springs 20,20 to form the air path 40, as shown in FIG. 4. Both elastic members 31,32 are as wide as the needle 210 or they are slightly wider than the needle to provide an air-tight condition where the front edges of these elastic members have direct physical contacts with the back of the needle 210, as shown in FIG. 5. In other words, these elastic members 31,32 in parallel perfectly fit the rear-side semicircular configuration of the needle 210.

The front lower edge of the elastic member 32 is configurated so as to perfectly fit the rear-side distal portion of the tapered needle 210 and provide an air-tight contact therewith, as shown in FIG. 4. The upper and lower elastic members 31, 32 are tapered to the right and the air path 40 gets gradually widened toward right, as also shown in FIG. 4, to prevent the sucked yarn from being tangled inside the air path 40.

The longitudinal oval holes 25, are formed on the thick materials 22,22 of the leaf springs 20,20 which are extended into the air suction pipe 10, as shown in FIGS. 4 and 5. These holes 25 provide leeway for the material 22 to move backward, absorbing a colliding impact when the needle 210 hits the elastic members 30,30 and bring about an elastic contact therewith. In these holes 25 are provided supporting pins 12 which are fastened at the outer surface of the air suction pipe 10.

A spring 50 is squeezed between two spring holders 24, 11 in the air suction pipe 10. One spring holder 24 is formed out of the material 22 which is extended deep into the air suction pipe 10. The other spring holder 11 is fixed to the air suction pipe 10, as shown in FIG. 4. The biased or squeezed spring 50 pushes forward the elastic materials 30,30 and the leaf springs 20,20 for the length of the leeway in the oval holes 25, and absorbs a colliding impact when the needle 210 hits the elastic members 30,30, also providing an elastic contact between the two colliding objects. The very nature of the upper and lower elastic members 31,32 contributes to achieving an elastic contact behind the needle 210, as well.

Air leakage must be prevented as the leaf springs 20,20 connected to the front edge of the air suction pipe 10 are made to move backward and forward. If the air leakage occurs where the leaf springs meet with the air suction pipe 10, the connection should be wrapped and sealed.

As shown in FIGS. 8 and 9, an air device 80 has dual functions of sucking and sending air for the threading apparatus 100 mounted on a base 71. While the air device 80 vacuums air to carry a yarn into the needle eye 210, it also sends air into an air cylinder 70 which makes the air suction pipe 10 and the elastic members 30,30 move back and forth in order to assist the automatic threading operation.

Figure 7:
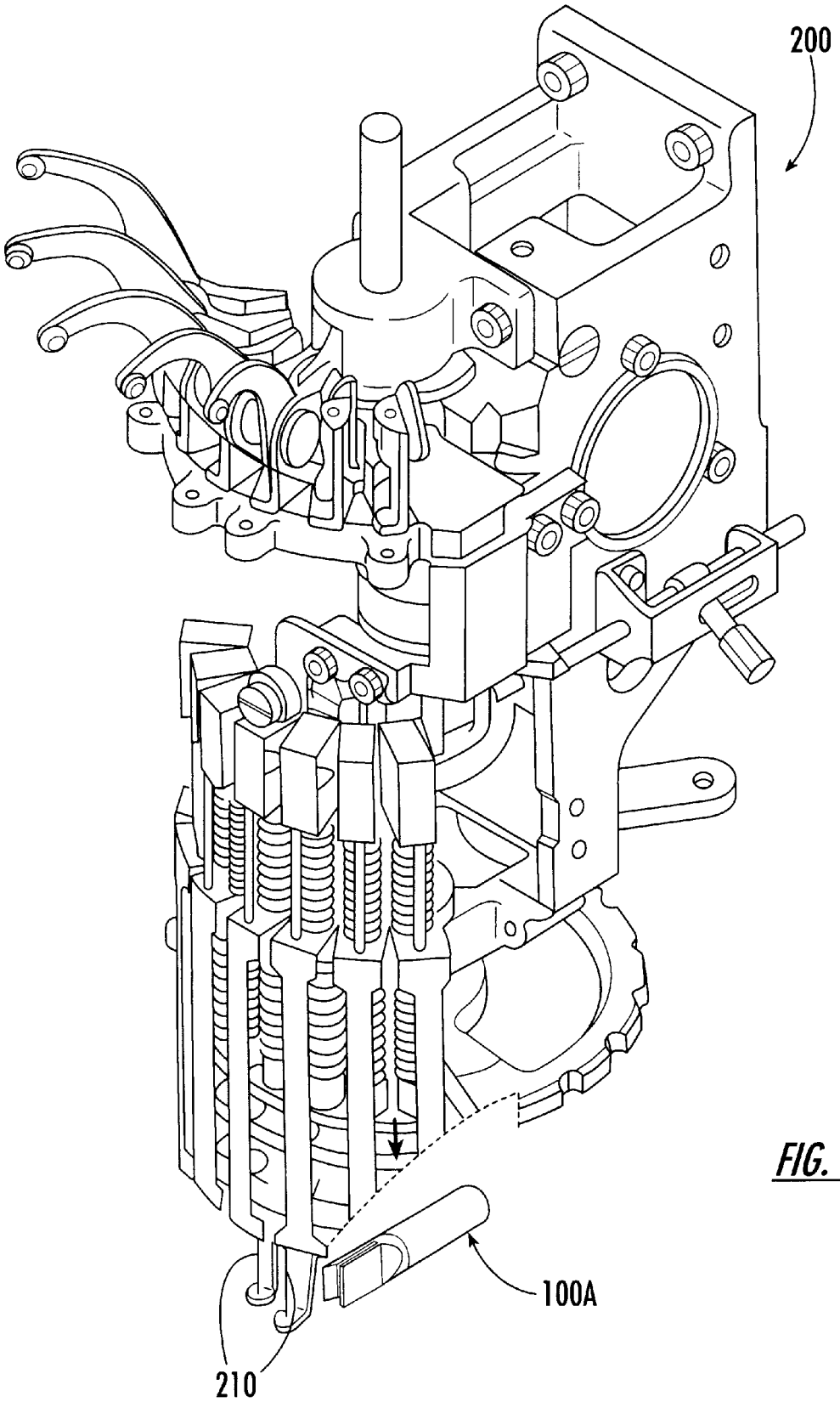
FIG. 7 is a perspective view showing an embroidering machine where a threading apparatus according to a preferred embodiment of the present invention is applied.

FIG. 7 illustrates an embroidering machine 200 having embroidery lace needles 210. Lace needles used for a particular embroidering operation can be positioned in front of the air suction device 100 A, for example, by placing or turning the device 100A to a right position. In this way, even multiple needles 210 of the embroidering machine 200 can be dealt with by the threading apparatus 100, which may be directly attached to the embroidering machine 200.

Although the embodiments of the present invention disclosed here constitute preferred forms, it should be understood that other embodiments and modification of the present invention are possible.

What is claimed is:

1. A threading apparatus having an air suction device for forming an air flow to direct a yarn into an eye of a needle, said air suction device comprising:

(a) an air device externally provided for generating reduced pressures;

(b) an air suction pipe connected to said externally provided air device; and (c) an air path leading to a front portion of said air suction pipe, said air path comprising a pair of leaf springs to horizontally hold the needle and upper and lower elastic members which run parallel between said pair of leaf springs.

2. A threading apparatus of claim 1, wherein each of said leaf springs comprises an elastic material with its tip portion slightly opened and a non-elastic material partially placed on top of said elastic material to provide an integrally formed outer layer, which is connected to a front side of said air suction pipe air-tightly with an uncovered part of said elastic material being left exposed.

3. A threading apparatus of claim 1, wherein said leaf springs are connected to a front portion of said air suction pipe which can move back and forth and a built-in biased spring in said air suction pipe pushes said leaf springs forward.

4. A threading apparatus according to any of claim 1, wherein a front distal portion of said lower elastic member is configurated to perfectly fit a tapered rear surface of the needle to provide an air-tight contact therebetween.

5. A threading apparatus according to any of claim 1, wherein said air suction device is mounted on a base, said air suction pipe together with said upper and lower elastic members reciprocating by means of an air cylinder.

6. A threading apparatus according to any of claim 1, wherein said air suction device is directly attached to a sewing machine, said air suction pipe together with said upper and lower elastic members reciprocating by means of said air cylinder.

* * * * *